US007339527B2

(12) United States Patent
Sager et al.

(10) Patent No.: US 7,339,527 B2
(45) Date of Patent: Mar. 4, 2008

(54) CONTROLLABLE ANTENNA ARRANGEMENT

(75) Inventors: Mads Sager, Roedovre (DK); Jens Troelsen, Copenhagen SV (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/535,737

(22) PCT Filed: Nov. 20, 2002

(86) PCT No.: PCT/EP02/12985

§ 371 (c)(1),
(2), (4) Date: May 18, 2005

(87) PCT Pub. No.: WO2004/047220

PCT Pub. Date: Jun. 3, 2004

(65) Prior Publication Data

US 2006/0044187 A1 Mar. 2, 2006

(51) Int. Cl.
*H01Q 1/38* (2006.01)

(52) U.S. Cl. ..... 343/700 MS; 343/745; 343/815; 343/816; 343/817; 343/846

(58) Field of Classification Search ..... 343/700 MS, 343/702, 787, 829, 846, 848
See application file for complete search history.

(56) References Cited

U.S. PATENT DOCUMENTS

| | | | | |
|---|---|---|---|---|
| 5,243,354 A | | 9/1993 | Stern et al. | 343/700 |
| 5,777,581 A | | 7/1998 | Lilly et al. | 343/700 |
| 5,917,385 A | * | 6/1999 | Sjogren | 333/81 A |
| 5,943,016 A | * | 8/1999 | Snyder et al. | 343/700 MS |
| 6,061,025 A | * | 5/2000 | Jackson et al. | 343/700 MS |
| 6,300,909 B1 | * | 10/2001 | Tsubaki et al. | 343/700 MS |
| 6,501,427 B1 | * | 12/2002 | Lilly et al. | 343/700 MS |
| 6,693,594 B2 | * | 2/2004 | Pankinaho et al. | 343/700 MS |
| 6,864,848 B2 | * | 3/2005 | Sievenpiper | 343/767 |

FOREIGN PATENT DOCUMENTS

| | | |
|---|---|---|
| EP | 0 869 579 A1 | 10/1998 |
| EP | 0 993 070 A1 | 4/2000 |
| EP | 1 248 317 A1 | 10/2002 |

(Continued)

*Primary Examiner*—Douglas W. Owens
*Assistant Examiner*—Chuc Tran
(74) *Attorney, Agent, or Firm*—Harrington & Smith, PC

(57) ABSTRACT

An antenna (11) includes a patch antenna element (22) capacitively coupled to a load patch (27). A switch (33) connects the load patch (27) to one of one or more strip lines (35, 37, 40), each of which has a different length. Each strip lines causes the load patch (27) to have a different impedance, with one causing a short circuit, one causing an open circuit, and one causing an impedance in between these extremes. Different impedances of the load patch (27) cause different frequencies of operation of the antenna patch (22) by virtue of the capacitive coupling therebetween. The antenna (11) is thereby tuneable to three separate frequencies. Other frequency bands are unaffected by virtue of the location of the load patch (27) relative to the antenna patch (22). By allowing tuning by way of controlling the impedance of the load patch (27), the antenna arrangement can be made smaller than a corresponding passive antenna operable at the same frequencies. By using an N throw switch, N strip lines of different lengths can be connected, each giving rise to a different operating frequency.

10 Claims, 8 Drawing Sheets

FOREIGN PATENT DOCUMENTS

| | | | |
|---|---|---|---|
| JP | 11068456 | A | 3/1999 |
| JP | 11136025 | A | 5/1999 |
| WO | WO 01/20718 | A1 | 3/2001 |
| WO | WO 02/078124 | A1 | 10/2002 |
| WO | WO 02/087014 | A1 | 10/2002 |

* cited by examiner

CONTROLLABLE ANTENNA ARRANGEMENT

CROSS-REFERENCE TO RELATED APPLICATIONS

This patent application claims priority under 35 U.S.C. §371 from international application No. PCT/EP2002/012985, filed Nov. 20, 2002.

FIELD OF THE INVENTION

This invention relates to an antenna arrangement, the frequency of which may be adjusted by control of a multiple throw switch connected to one or more strip or microstrip lines.

BACKGROUND OF THE INVENTION

It is relatively common for radiotelephone handsets to include internal patch antenna arrangements, since these are relatively inexpensive to manufacture and since they can have suitably narrow bandwidths at desired operating frequencies. However, the use of patch antennas presents a problem when the radiotelephone is required to operate in more than two multiple frequency bands, for example in the PCS and DCS bands as well as the GSM 900 band. The PCS band comprises the frequencies 1850 to 1990 MHz, and the DCS transmitter band comprises the frequencies 1710 to 1785 MHz, the DCS receiver band comprises the frequencies 1805 to 1889 MHz.

Patch antennas which are arranged to operate multiple frequency bands are known from, for example, U.S. Pat. No. 5,777,581, which discloses a patch antenna connectable to plural tuning strips by respective switches. An antenna more suitable for use in mobile telephone applications is disclosed in JP11-136025. In this document, a ground plane and an antenna element are formed on opposite faces of a substrate. The antenna element is grounded at one end, can be coupled to ground at another end by a controllable switch. Further switches may couple other locations on the antenna element to ground potential, allowing the antenna to be tuned to plural discreet frequencies.

It is an aim of the invention to provide an improved antenna arrangement.

SUMMARY OF THE INVENTION

According to a first aspect of the invention, there is provided an antenna arrangement comprising a multiple throw switch arranged to couple one or more strip or microstrip lines to an antenna element.

Preferably, the antenna arrangement comprises a load element capacitively coupled to the antenna element, the switch being connected to the load element. This arrangement is particularly advantageous since it allows tuning of the antenna element without the direct connection of the switch to the antenna element. This, in turn, allows tuning to any frequency over a range permissible by the load element. Preferably, the load element is a patch. In one embodiment, the load element is on a surface of substrate such that the load element is perpendicular to the antenna element. However, any suitable arrangement may be used, the main requirement being that the load element is capacitively coupled to the antenna element such that the frequency of the antenna element can be adjusted by adjusting the impedance of the load element.

According to a second aspect of the invention, there is provided an antenna arrangement comprising a load element capacitively coupled to an antenna element, and a switch arranged to connect one of one or more strip or microstrip lines to the load element.

The use of one or more strip or microstrip lines of different lengths is advantageous since the phase difference caused by the impedance of the strip or microstrip line leads to the desired effect of controllable impedance in the antenna arrangement. Control of the impedance which can result from using the invention is advantageous since the antenna element can be tuned accurately by suitable control of the switch.

Preferably, the switch is connected to at least two or more strip or microstrip lines. Since the frequency of the antenna element depends on the length of the strip or microstrip line, the use of plural lines allows the antenna element to be tuned to plural frequencies. Preferably, one throw of the switch is connected to a strip or microstrip line of substantially zero length. A zero length strip or microstrip line can still cause reflection, resulting in a desired impedance which in turn results in a desired frequency of operation. By suitable design, the number of strip or microstrip lines with a length larger than zero can be fewer than the number of frequencies to which the antenna arrangement is tuneable.

The embodied antenna arrangements include a feed connection and a ground connection applied directly to the antenna element, with the switch being connected separately from either of these connections. This has the advantage that the switch causes loss only at the frequency band where the switching takes place. If the switch were to be associated with either the ground connector or the feed connector, all frequency bands of the antenna would suffer from the loss of the switch.

The invention also provides a radiotelephone including an antenna arrangement according to the invention.

BRIEF DESCRIPTION OF THE DRAWINGS

Embodiments of the present invention will now be described, by way of example only, with reference to the accompanying drawings, of which.

DESCRIPTION OF THE PREFERRED EMBODIMENTS

Figure 1:
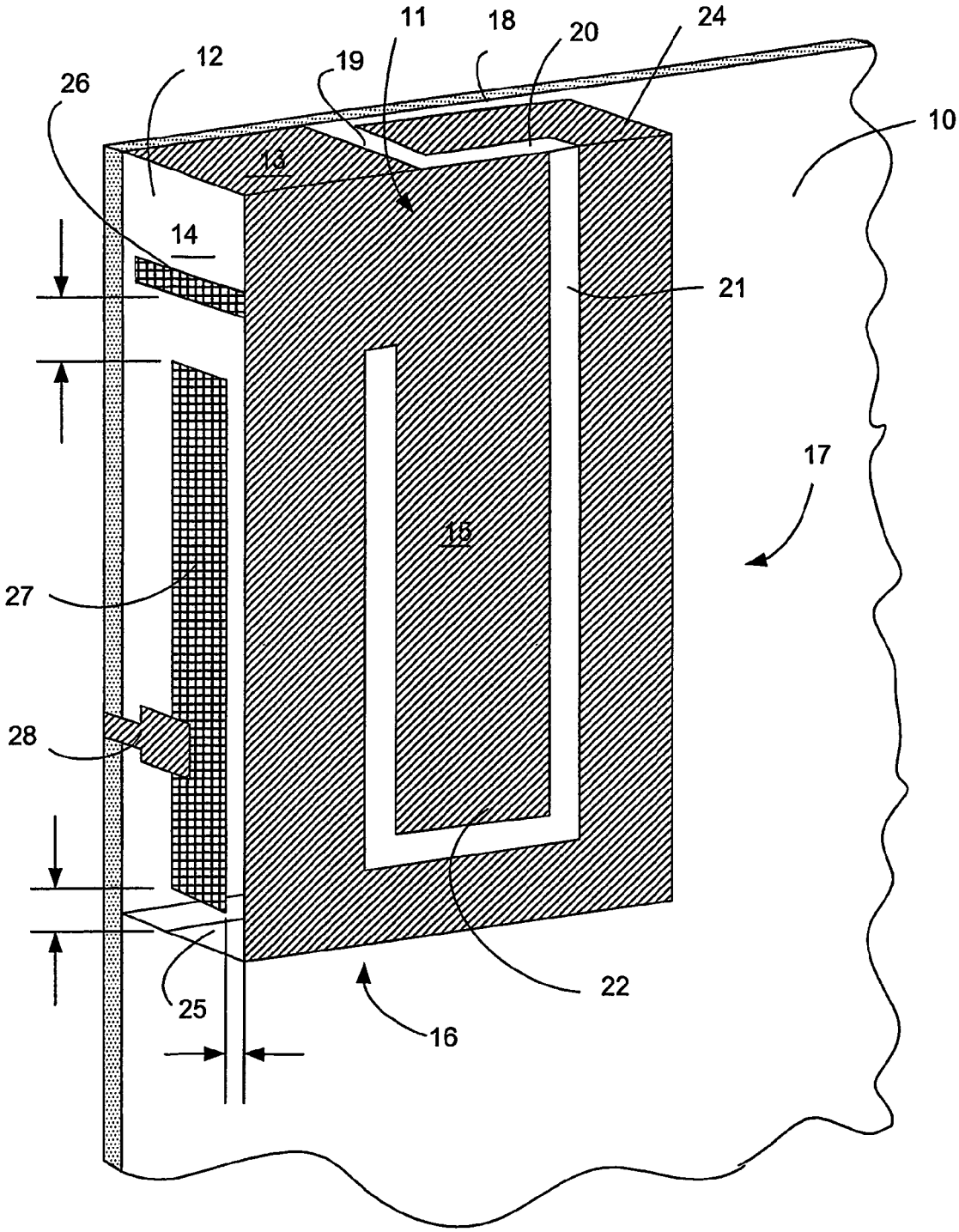
FIG. 1 is a schematic perspective drawing of an antenna arrangement according to the invention, mounted on a printed wire board.

Referring firstly to FIG. 1, a printed wire board 10 is shown in perspective. Mounted on a front surface of the printed wire board 10 is an antenna. The antenna 11 comprises a substrate 12 comprised of a plastic, such as polycarbonate (PVC), having a three dimensional rectangular shape. A first face 13 of the substrate, which is upper-most shown in the drawing, has a length of 12 mm, adjoining printed wire board 10 on one side, and a height of 6 mm. A second face 14 of the substrate 12, which is leftmost shown in the drawing, has a length of 30 mm adjoining the printed wire board 10, and a height of 6 mm. One of the 6 mm high edges adjoins the first face 13. A third face 15, which adjoins the first and second faces 13, 14 and is opposite to the printed wire board 10, has a length 30 mm and a width 12 mm. A fourth face 16 is opposite to and has the same dimensions as the first face 13. A fifth face 17 is opposite to and has the same dimensions as the second face 14. The fifth face has no features formed thereon. The first and third faces 13, 15 are completely metallised except for a slit which extends from the printed wire board across the first face onto the third face. The slit comprises a first portion 18, which extends along the edge of the first face 13 which adjoins the printed wire board from a point opposite the junction of the first and second faces. The first portion 18 extends for approximately 7 mm. A second portion 19 of the slit extends then perpendicularly from the printed wire board to the junction with the third face 15. A third portion 20 of the slit then runs on the first face 13 along the junction with the third face 15 and away from the second face 14 for approximately 4 mm. A fourth portion 21 of the slit then runs for approximately 25 mm along the length of the third face, when it turns perpendicularly towards the second face 14 for approximately 5 mm before turning perpendicularly again and running towards the first face 13 for approximately 20 mm. The placement, width and shape, and indeed the presence, of the fourth portion 21 of the slit on the third face 15 is not critical to the invention, as will be appreciated. The slit effects a size reduction. Without the slit, the antenna would be folded out reaching a total length of around 8 cm (quarter of a wavelength at the lowest band, 900 MHz).

The metallisation formed on the third face 15 constitutes an antenna element 22 in the form of a patch. The patch antenna element 22 is connected to a ground plane (shown in FIG. 2) on the printed wire board 10 by a ground connection 23, which is formed by the metallisation on the first face which is between the second portion 19 of the slit and the second face 14. The remaining metallisation on the first face constitutes a fixed capacitive load 24.

On the fourth face 16, metallisation is present for a 3 mm strip 25 of the face which runs lengthwise along the face and which adjoins the patch antenna element 22. This constitutes part of the antenna element, and helps to connect it capacitively to the ground plane.

On the second face 14 of the substrate 12, a feed connector 26 having a width of approximately 2 mm is connected at one end to the patch antenna element 22 and extends perpendicularly along the second face to a feed connection on the printed wire board 10. The feed connector 26 is located approximately 5 mm from the end of the second face 14 which adjoins the first face 13.

Also on the second face 14, a load patch 27 is formed having a length of approximately 19 mm and a width of approximately 3 mm. One end of the load patch 27 is separated from the feed connector 26 by a gap of approximately 3 mm. The load patch 27 is separated from the patch antenna element 22 by a gap of approximately 0.8 mm, and the size of the gap remains constant for the entire length of the load element 27. An end of the load element 27 opposite to the feed connector 26 is separated from the end of the second face 14 by a gap of approximately 0.8 mm. The load element 27 and the feed connector 26 are formed of metalisation layers. The load element 27 is connected to circuitry on the reverse face of the printed wire board 10 by a connector 28.

The distance between the load element 27 and the patch antenna element 22 determines the amount of coupling between the two elements. Although in this embodiment the gap is 0.8 mm wide, it could take any distance between 0.1 mm and 2 mm. The distance between the load element and the feed connector 26 also has an affect on the amount of coupling between the antenna element 22 and the load element, as does the distance between the load element and the metallisation 25 on the fourth face 16.

The substrate 12 can take any suitable form. For example, the substrate 12 need not be a solid rectangular block, but could be comprised of a box formed from PVC walls having a thickness of 0.5 mm. The metallisation of the antenna and load elements etc. could be formed on an inside surface or an outside surface of the box. The dielectric constant of the material used to form the substrate 12 is important, since this has an effect on the dimensions of the antenna element 22 needed for operation at a given frequency.

Figure 2:
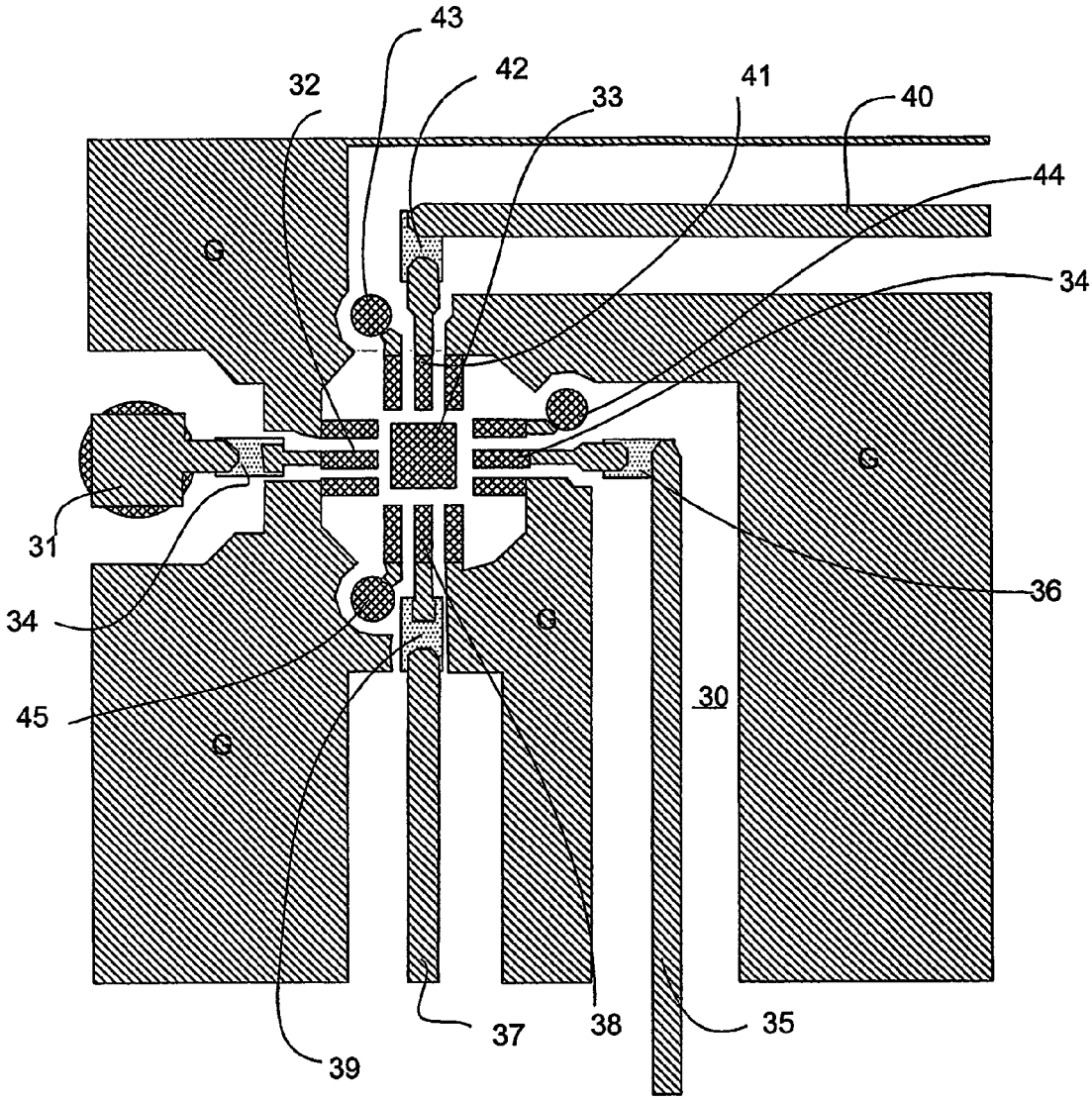
FIG. 2 is a plan view of the reverse side of the printed wire board of FIG. 1.

Referring now to FIG. 2, a surface of the printed wire board 10 is shown in plan view. The surface 30 may be opposite to the substrate 12, but is preferably on the same side thereto. Here, a pad 31 connects to the connector 28 which in turn connects to the load patch 27. The pad 31 is connected to a pole 32 of a single pole switch 33. The connection between the pad 31 and the switch 33 is made by a first capacitor 34, having a capacitance of 47 pF. A first throw 35 of the switch 33, which is physically opposite to the pole 32 is connected to a first strip line 35 by a second capacitor 36. A second strip line 37 is connected to a second throw 38 of the switch 33 via a third capacitor 39. Similarly, a third strip line 40 is connected to a third throw 41 of the switch 33 via a fourth capacitor 42. Each of the second, third and fourth capacitors 36, 39, 42 has a capacitance of 47 pF. A ground plane is formed between but electrically insulated from the various components. The switch 33 is controlled by application of suitable voltages to three control voltage points 43-45. During operation, a voltage of around 3V is applied to one point and the remaining two points are grounded at any one time.

The switch 33 may take any suitable form. One such suitable switch is the AS 202-321 produced by Skyworks Solutions, Inc of 20 Sylvan Road, Woburn, Mass., USA.

Each of the strip lines 35, 37 and 40 has a different length, and each terminates with a square end. The strip lines 35, 37, 40 may be 50 Ω strip lines. The length of the strip lines 35, 37 and 40 are selected such that they provide the load patch 27 with impedances which give rise to the antenna arrangement 11 having desired frequency characteristics.

The frequency of the antenna element 22 is unaffected by the load patch 27 when the load patch is presented to a very high (e.g. open circuit) impedance at the junction with the connector 28 because the capacitive loading is minimised. When the load patch 27 is presented to a zero impedance (short circuit) at the junction with the connector 28, the resonant frequency of the antenna element 22 is reduced by the maximum amount allowable by the antenna 11, because the capacitive loading is maximised. Providing the load patch 27 with another 'reflecting' impedance between these extremes results in the resonant frequency taking a value between the two extremes. By varying only the phase of the impedance presented to the load patch at the junction with the connector 28, the impedance presented to the load can be varied between open circuit and short circuit. The phase of the impedance presented to the load patch 27 at the junction with the connector 28 is a function of the frequency and of the combined electrical length of the connector 28, the link from the connector to the pole 32, the switch 33, the link from the switch to the start of the relevant strip line 35, 37, 40 and the electrical length of the strip line itself. Hence, by connecting a strip line having a certain physical length, thereby also an electrical length to the load patch 27, the phase of the impedance to the load patch is controlled, and thus the resonant frequency of the antenna 11, is controlled. The electrical length of the strip lines 35, 37, 40 is determined by the electrical properties of the material. In this embodiment, the printed wire board is an FR4 substrate, which has a dielectric constant of around 4.5.

Figure 3:
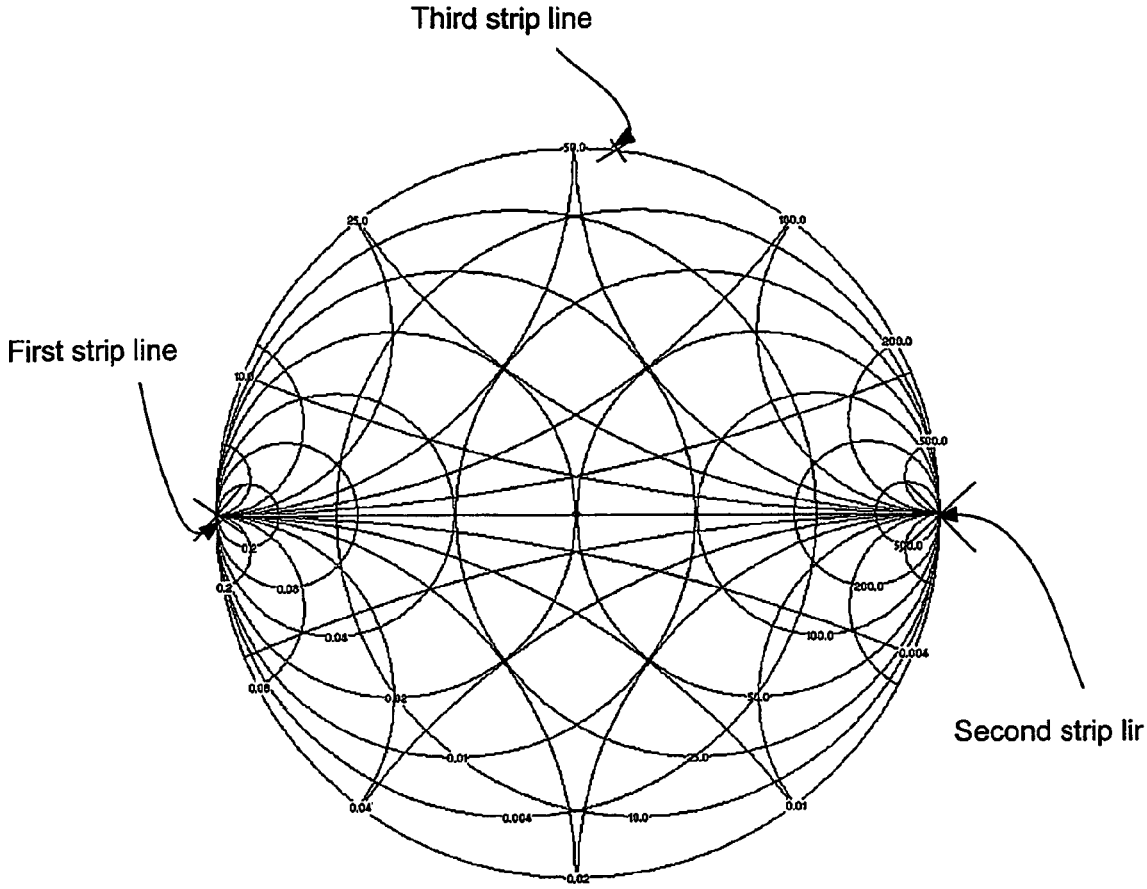
FIG. 3 shows a Smith chart used to illustrate operation of the FIGS. 1 and 2 antenna arrangement.

In FIG. 2, the second strip line 37 has a length of 5 mm which, considering the length of the path from its end to the load patch 27, gives an open circuit at 1.9 GHz. This, when the second strip line 37 is connected by the switch 33 to the load patch 27, allows the arrangement to operate at the 1850-1990 MHz PCS frequencies. The first strip line 35 has a length of around 25 mm, which provides the load patch 27 with a short circuit at 1.8 GHz. Accordingly, when the first strip line is connected to the load patch 27 by the switch 33, the antenna 11 is caused to resonate at the DCS Tx frequencies of 1710-1785 MHz. The third strip line 40 has a length of around 15 mm. It therefore gives rise to an intermediate complex impedance of around (0-j20)Ω at 1.8 GHz. This allows operation of the antenna arrangement when the third strip line is connected to the load patch 27 by the switch 33 at the DCS Rx frequencies of 1805-1880 MHz. The difference in the lengths of the first and second strip lines 35, 37 corresponds to one quarter of the wavelength of signals at around 1.85 GHz (on an FR4 substrate), which equates to a 90 degree phase shift of the impedance presented to the load patch by the switching circuit. A Smith chart showing the impedances presented to the load patch 27 at the junction with the connector 28 when each of the strip lines 35, 37, 40 is caused to be connected thereto by the switch 33 is shown in FIG. 3.

Figure 4:
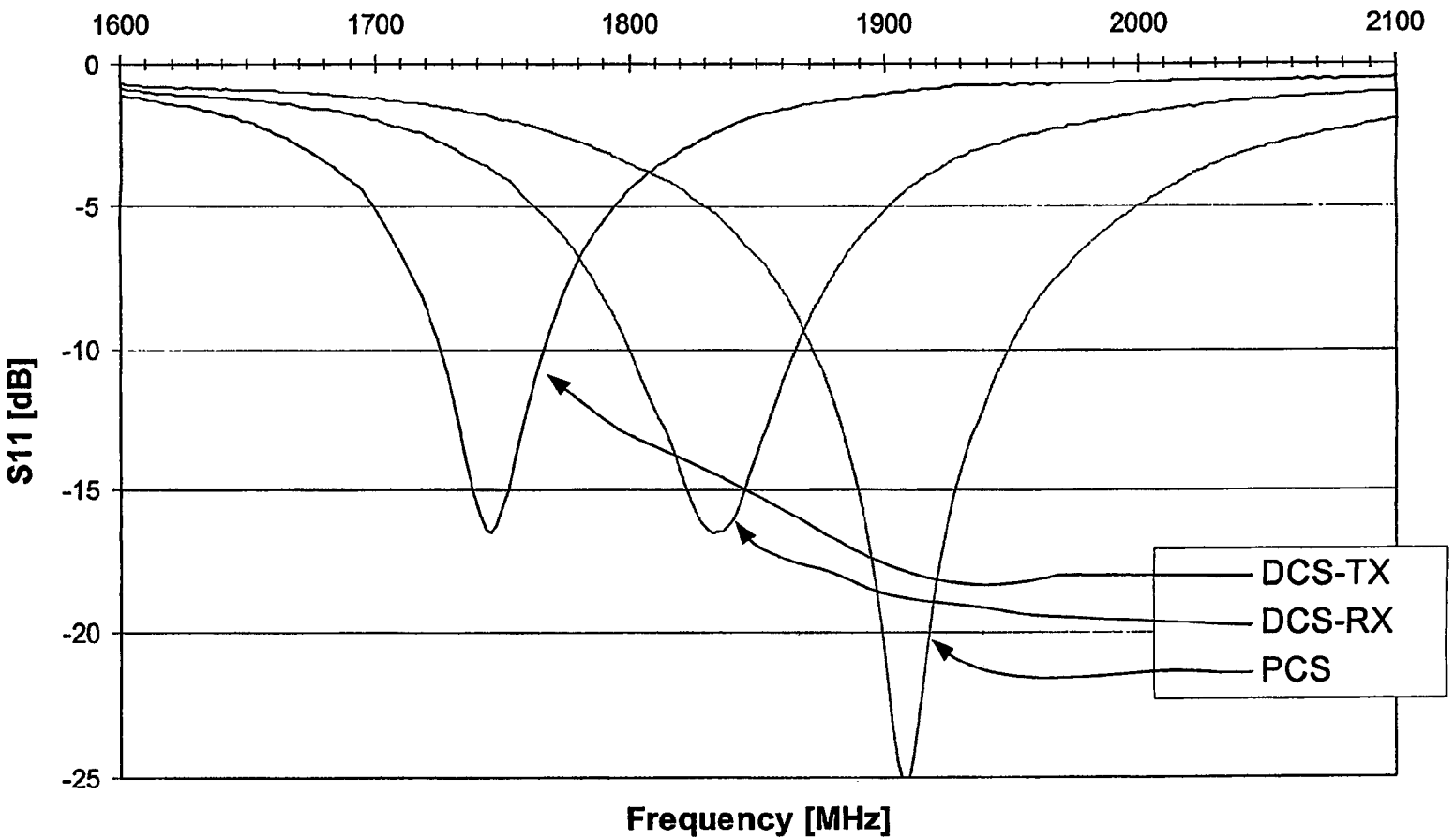
FIGS. 4, 5 and 6 illustrate the performance of the antenna arrangement of FIGS. 1 and 2.
Figure 5:
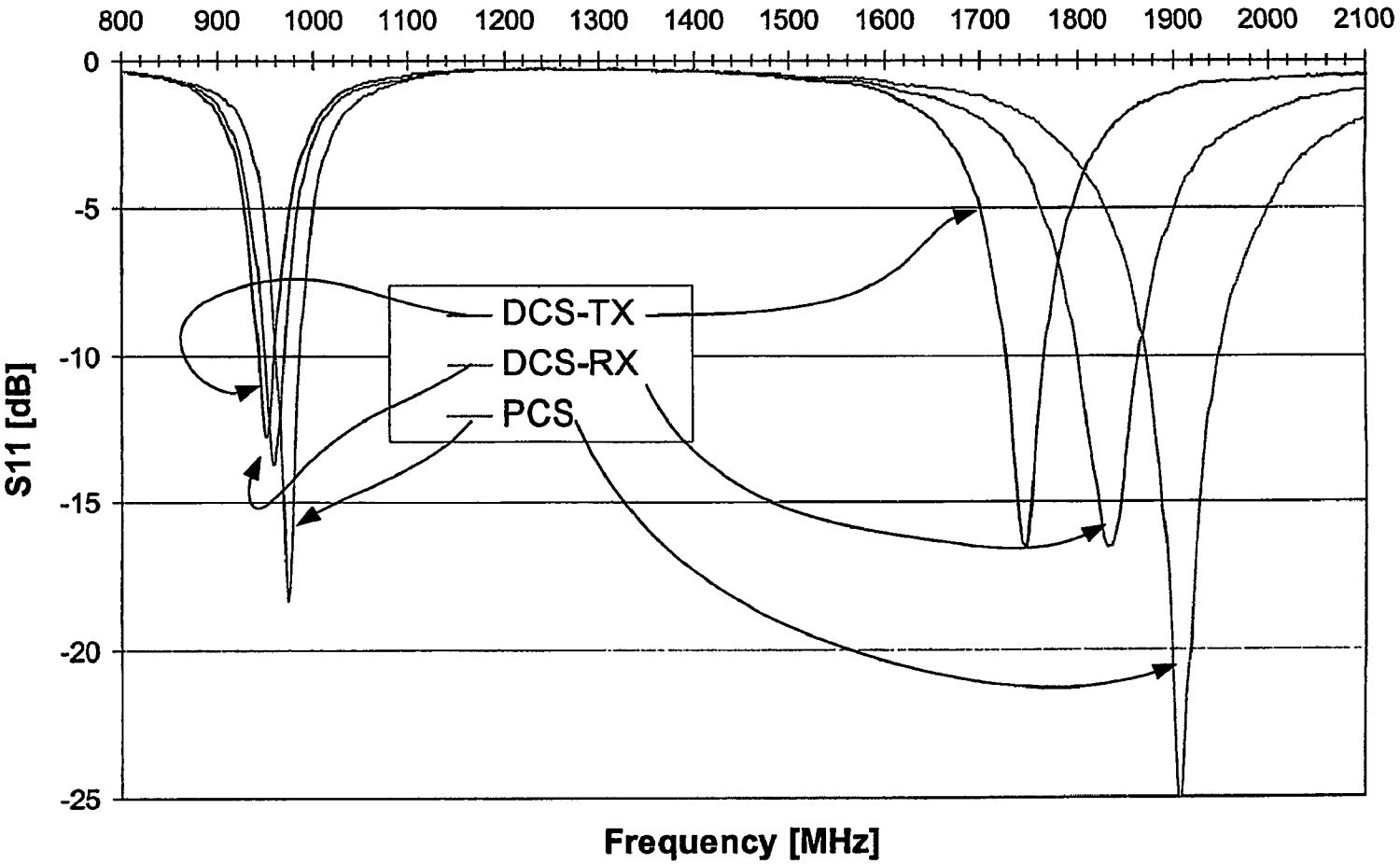
Figure 6:
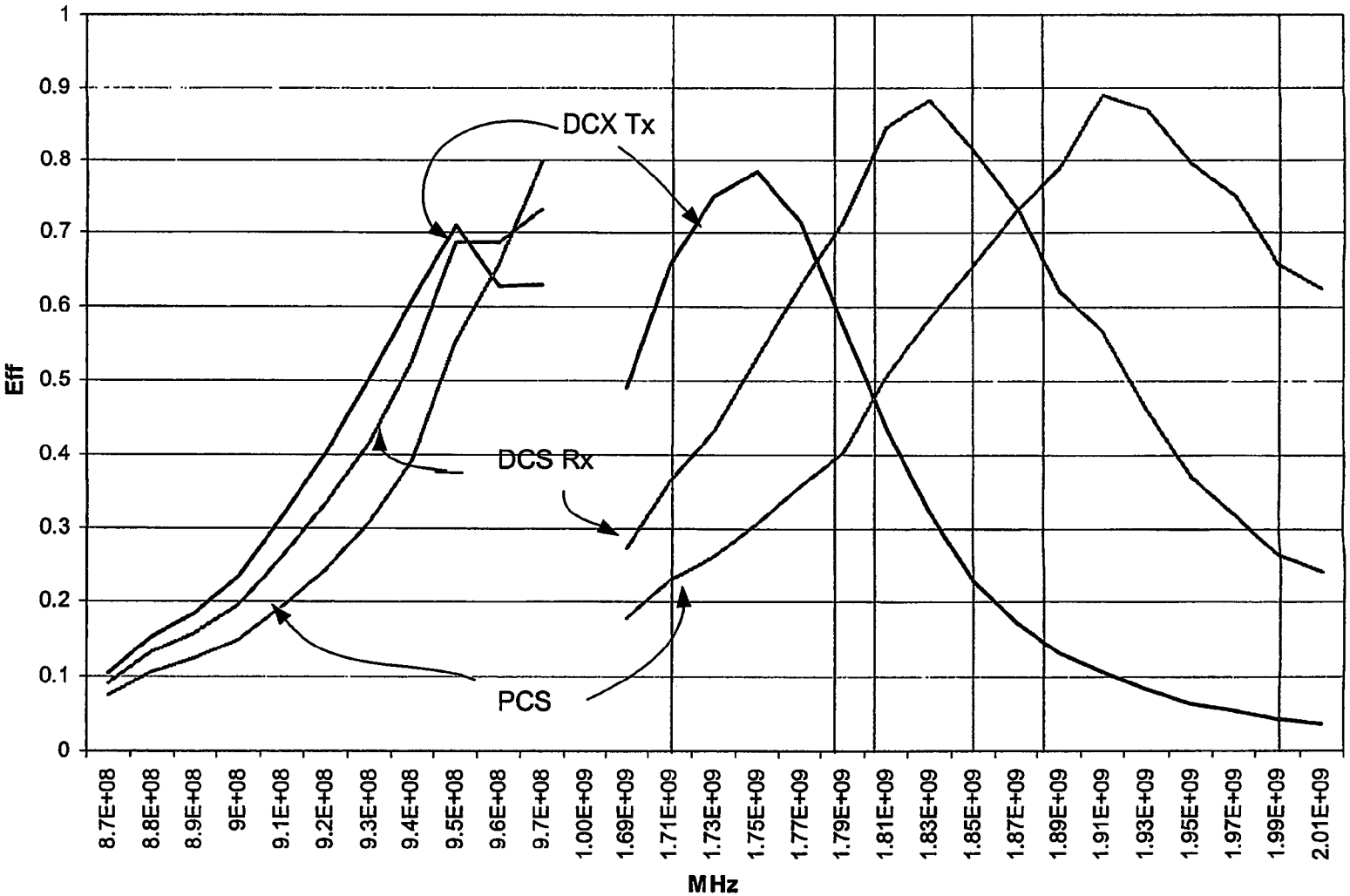

Performance of the antenna 11 is illustrated by the graphs of FIGS. 4 and 5. Here, the S11 curves are shown for the higher frequency band, in FIG. 4, and for the higher and lower frequency bands, in FIG. 5. She realised efficiency of the antenna 11, as measured in a 3D near field chamber, is shown in FIG. 6.

Although the above-described embodiment includes three strip lines, allowing tuning to three discreet-frequencies, the invention is not so limited. In a further embodiment (not shown), a 4 throw switch is used, each throw being connected to a respective strip line of unique length. In this way, the antenna arrangement is tuneable to four discreet frequencies. By selecting suitable lengths of strip line, the antenna arrangement can be tuneable to, for example, the DCS Tx and Rx frequencies and the PCS Tx and Rx frequencies.

Advantages arise from the fact that the load element is capacitively coupled to the antenna element, and the fact that the impedance of the load element can be controlled to adopt any one of a number of discreet steps which is equal to the number of throws on the switch.

Also, by allowing tuning by way of controlling the impedance of the load element, the antenna arrangement can be made smaller than a comparable antenna operable at the same frequencies. The applicants have produced the antenna of FIGS. 1 and 2, and found that it offers comparable performance whilst occupying a volume less than half that of a corresponding passive antenna arrangement operable at the same frequencies. Volume reduction is of particular significance when the antenna arrangement is used in mobile wireless devices, such as radiotelephones. A board of a radiotelephone is shown in FIG. 7.

Figure 7:
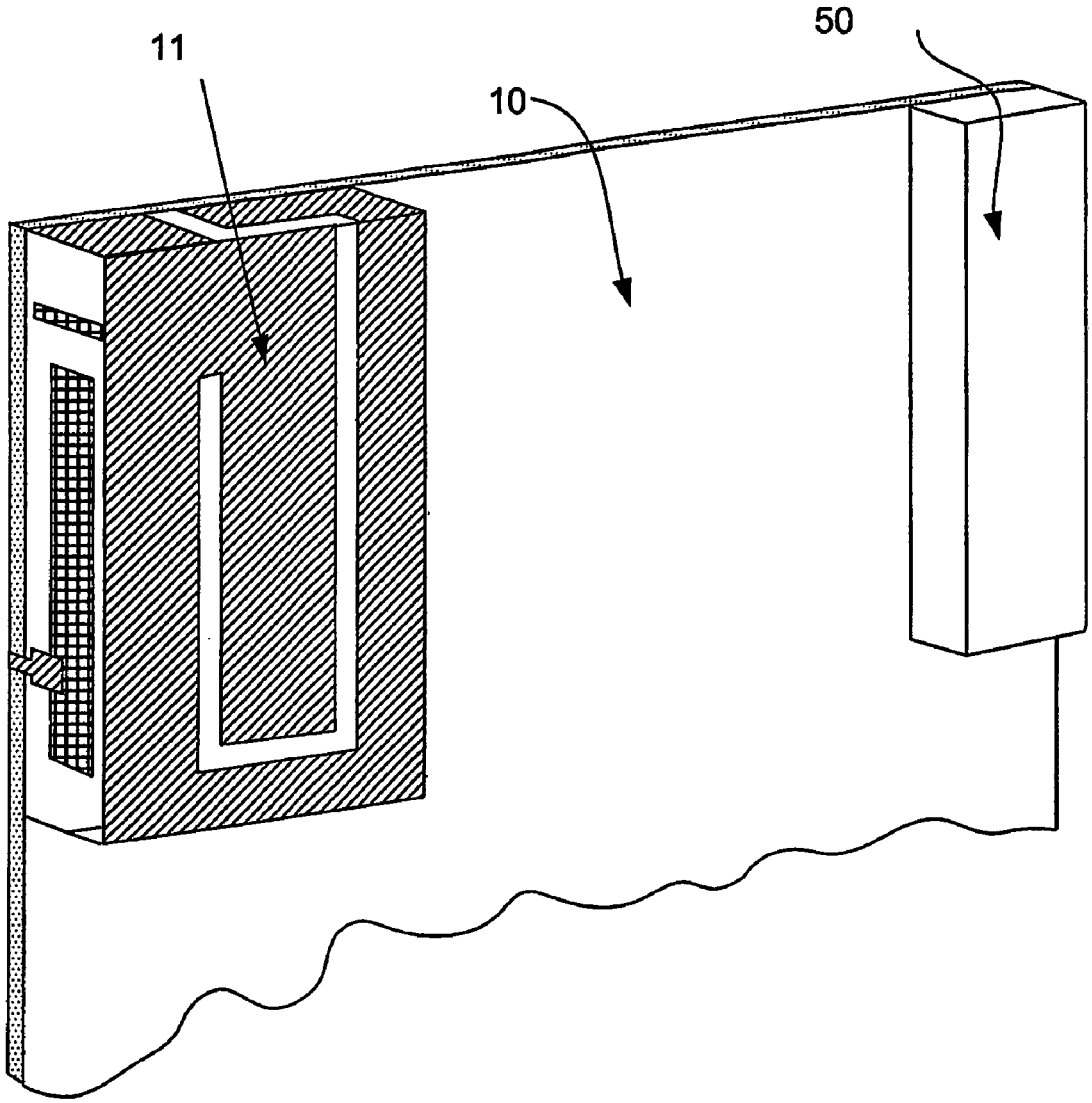
FIG. 7 shows the antenna arrangement of FIG. 1 mounted alongside a second antenna arrangement to form part of a radiotelephone.

Referring to FIG. 7, a printed wire board 10 is provided at a top left corner thereof with the antenna arrangement 11. Although not shown, the switch 33 and strip lines are connected to the antenna 11 as appropriate from the reverse side of the printed wire board 10. A WCDMA (wideband code division multiple access) antenna 50 is attached to the top right corner of the printed wire board 10, and is fed by suitable connections on the reverse side of the printed wire board. The WCDMA antenna 50 allows operation of the radiotelephone in the 3G system, which has an operating bandwidth from 1920 MHz to 2170 MHz.

Since the antennas 11 and 50 have greater physical separation from each other, resulting from the smaller size of the antenna 11, the amount of radio frequency isolation between them is increased. Furthermore, when the WCDMA antenna 50 is in use, the switch 33 is controlled so that the load patch provides a short circuit, causing the antenna 11 to operate at the DCX Tx band of 1710-1785 MHz. Accordingly, significant frequency isolation of the two antennas 11 and 50 is obtained.

Referring again to FIGS. 1 and 2, it will be appreciated that the insertion loss of the switch 33 has a negative effect on the performance of the antenna. However, since the load patch 27 is located such that it has a significant effect only on the higher (1700-2000 MHz) frequency band of the antenna 11, the switch has a negative effect only at those frequencies. The switch 33 does not provide any substantial loss at other operating frequencies, such as the 900 MHz GSM frequencies, so radiation in this band does not suffer from the presence of the switch.

Another advantage is that potential type approval problems are avoided since the switch 33 is not in the chain between the (unshown) amplifier and the antenna patch 22.

Since the impedance presented by the load patch 27 depends on the lengths of the strip lines 35, 37, 40, adjustment of the resonant frequency can be effected at a late stage in antenna design. In particular, the mass-production tools for the antenna do not need to be modified for a final tuning of the operating frequencies; instead adjustment can take place by changing the length of the strip lines on the printed wire board 10. Furthermore, the design can be optimised such the minimum amount of area of the reverse side of the printed wire board 10 is required for implementing the FIG. 2 components. In particular, appropriate placement of the switch 33 can give rise to the shortest of the strip lines having a length of 0 mm. As well as this in itself saving space on the board 10, it allows the other strip lines to take the minimum possible length, providing further space savings.

It will be appreciated that the antenna element 22 constitutes a dual-band PIFA (planar inverted F-antenna). The placing of the load patch 27 is important, since it determines which frequency bands of the antenna element 22 it has an effect on. With the load patch 27 being located as shown in the Figures, only the high frequency bands are affected by its impedance. Control of the operating frequency at a low band could be effected by including a load patch at a suitable location, and by including a controllable switch and strip line arrangement with it.

In a further embodiment (not shown), the load patch 27 is included on the fifth face 17, where it has an effect on the lower frequency band of the antenna arrangement 11. The load patch of this embodiment is connected via a two-throw switch to one of two strip lines. One of the strip lines provides a short circuit at frequencies of around 850 MHz, causing operation of the antenna at 850 MHz. The other strip line provides an open circuit, causing operation of the antenna at 900 MHz. Thus, the antenna arrangement is operable at the two different sub-1 GHz frequencies.

Figure 8:
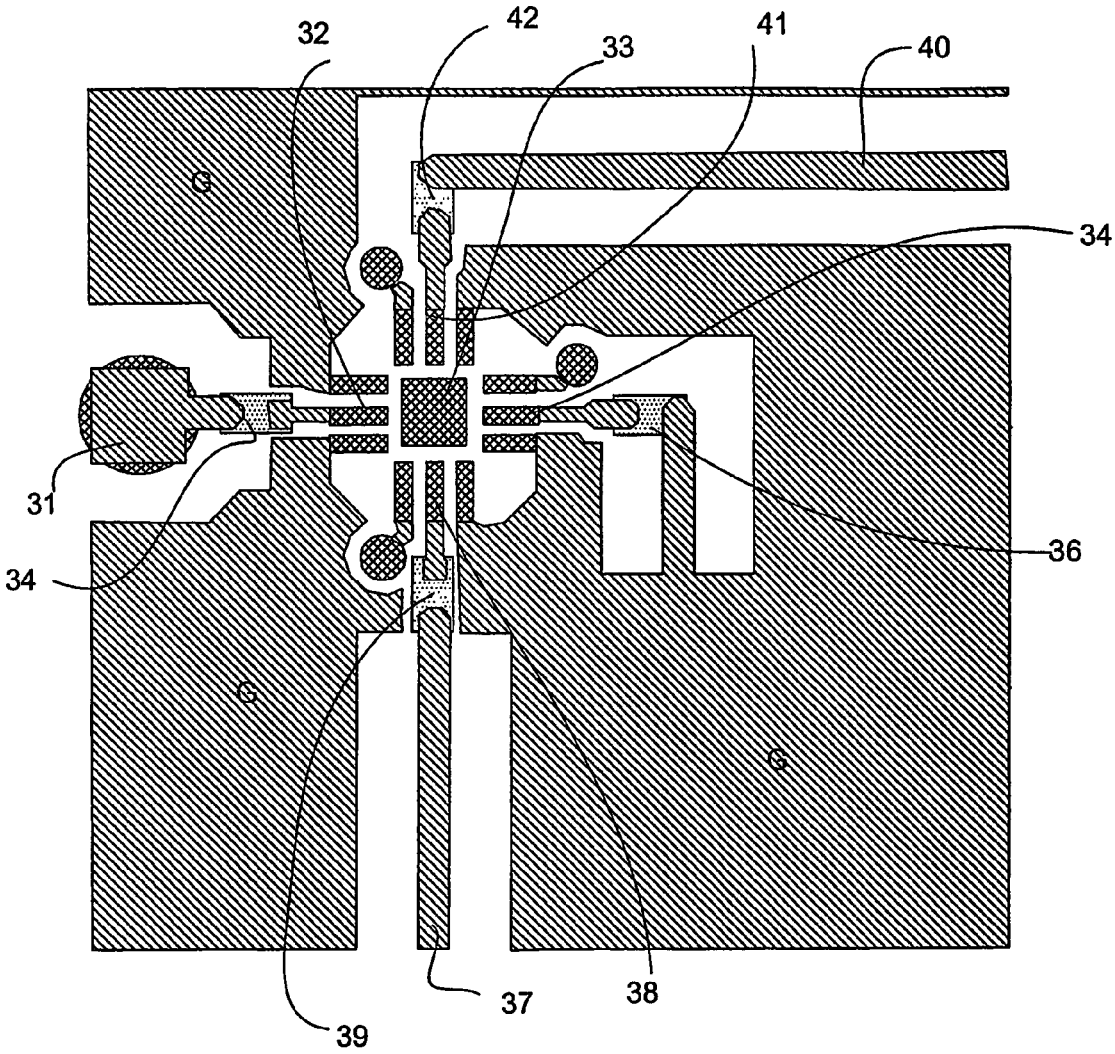
FIG. 8 illustrates an alternative method of strip line termination.

An alternative embodiment is illustrated in FIG. 8. Here, reference numerals are retained from FIG. 2 for like elements. Here, though, the first strip line 35 (the longest one) is terminated by connection to the ground plane G. The length of the strip line 35 is 5 mm, which is 20 mm shorter than in the FIG. 2 embodiment. The same impedance is provided when the strip line 35 is connected to the load patch by the switch since the phase of signals is shifted 90 degrees by virtue of the shorting to the ground plane G. This technique can be used to shorten strip lines where their length is inconvenient to the antenna design.

Instead of strip lines formed on the surface of the printed wire board, the invention may be implemented using microstrip lines (not shown). In this case, the microstrip lines are embedded in the printed wire board 10.

The invention claimed is:

1. An antenna arrangement comprising:

an antenna element;

a frequency adjusting arrangement for tuning said antenna element, wherein said frequency adjusting arrangement comprises:

a load element capacitively coupled to said antenna element;

at least two lines, each of said at least two lines comprising one of a strip line or a microstrip line; and a switch, the switch having at least two throws, each throw of said switch being connected to a different one of said at least two lines, the switch being arranged to connect one of said at least two lines to said load element.

2. An antenna arrangement as claimed in claim 1, in which said load element is a patch.

3. An antenna arrangement as claimed in claim 1, in which said antenna element is a patch.

4. An antenna arrangement as claimed in claim 1, in which one of said at least two throws of said switch is connected to a strip or microstrip line of substantially zero length.

5. An antenna arrangement as claimed in claim 1, in which one of said lines, when coupled to said load element via the switch, provides a substantially open circuit at an operating frequency of said antenna arrangement.

6. An antenna arrangement as claimed in claim 1, in which one of said strip or microstrip lines, when coupled to the antenna element via the switch, provides a substantially short-circuit at an operating frequency of the antenna arrangement.

7. An antenna arrangement as claimed in claim 1, in which one of said lines, when coupled to said antenna element via said switch, provides an impedance between a short and an open circuit at an operating frequency of said antenna arrangement.

8. An antenna arrangement as claimed in claim 1, in which at least one of said lines is connected to ground at its end opposite to said switch.

9. An antenna arrangement as claimed in claim 1, in which at least one of said lines is insulated from ground at its end opposite to said switch.

10. A radio telephone including an antenna arrangement as claimed in claim 1.

* * * * *